United States Patent [19]

Soriano

[11] 4,248,433

[45] Feb. 3, 1981

[54] CHAIN REACTION FALLING PLAYING PIECES BOARD GAME

[75] Inventor: Rene Soriano, Fresh Meadows, N.Y.

[73] Assignee: Ned Strongin Associates, Inc., New York, N.Y.

[21] Appl. No.: 54,017

[22] Filed: Jul. 2, 1979

[51] Int. Cl.[3] ..... A63F 3/00

[52] U.S. Cl. ..... 273/275; 46/1 R; 273/282

[58] Field of Search ..... 273/275, 282, 287; 46/1 R, 1 N

[56] References Cited

U.S. PATENT DOCUMENTS

| | | | |
|---|---|---|---|
| 2,776,835 | 1/1957 | Wilson | 273/86 R |
| 3,516,671 | 6/1970 | Estrin | 273/275 X |
| 3,907,302 | 9/1975 | Butler | 273/282 |
| 3,964,747 | 6/1976 | Balmforth | 273/261 |
| 4,150,828 | 4/1979 | Marchese | 273/282 X |
| 4,190,256 | 2/1980 | Rudden | 273/275 |

*Primary Examiner*—Anton O. Oechsle
*Attorney, Agent, or Firm*—Edward F. Levy

[57] ABSTRACT

An action game in which a plurality of elongated playing pieces are placed in upstanding condition on a game board in selected positions in an attempt to form a continuous unbroken line of playing pieces from one player's king playing piece at a playing station at one end of the game board to the opponent's king playing station at a playing station at the other end of the game board. If the playing pieces are properly set in such line and are properly oriented with relation to each other, the pushing over of said one player's king playing piece will cause the playing pieces in the line to topple over successively, each striking the next playing piece, in a chain reaction of cascading playing pieces, at the end of which the opponent's king playing piece is toppled. The playing board contains a pattern of spaced cells into which the playing pieces are inserted, the cells being staggered and arranged so that no straight line of cells extends from one player's king playing pieces to the other player's king playing pieces. Each cell is so configured that a playing piece may be inserted therein in any one of three preselected directions. Each playing piece is formed with a pointed, angular upper end, permitting the chain reaction of toppling playing pieces in the line to turn corners.

5 Claims, 12 Drawing Figures

FIG. 1
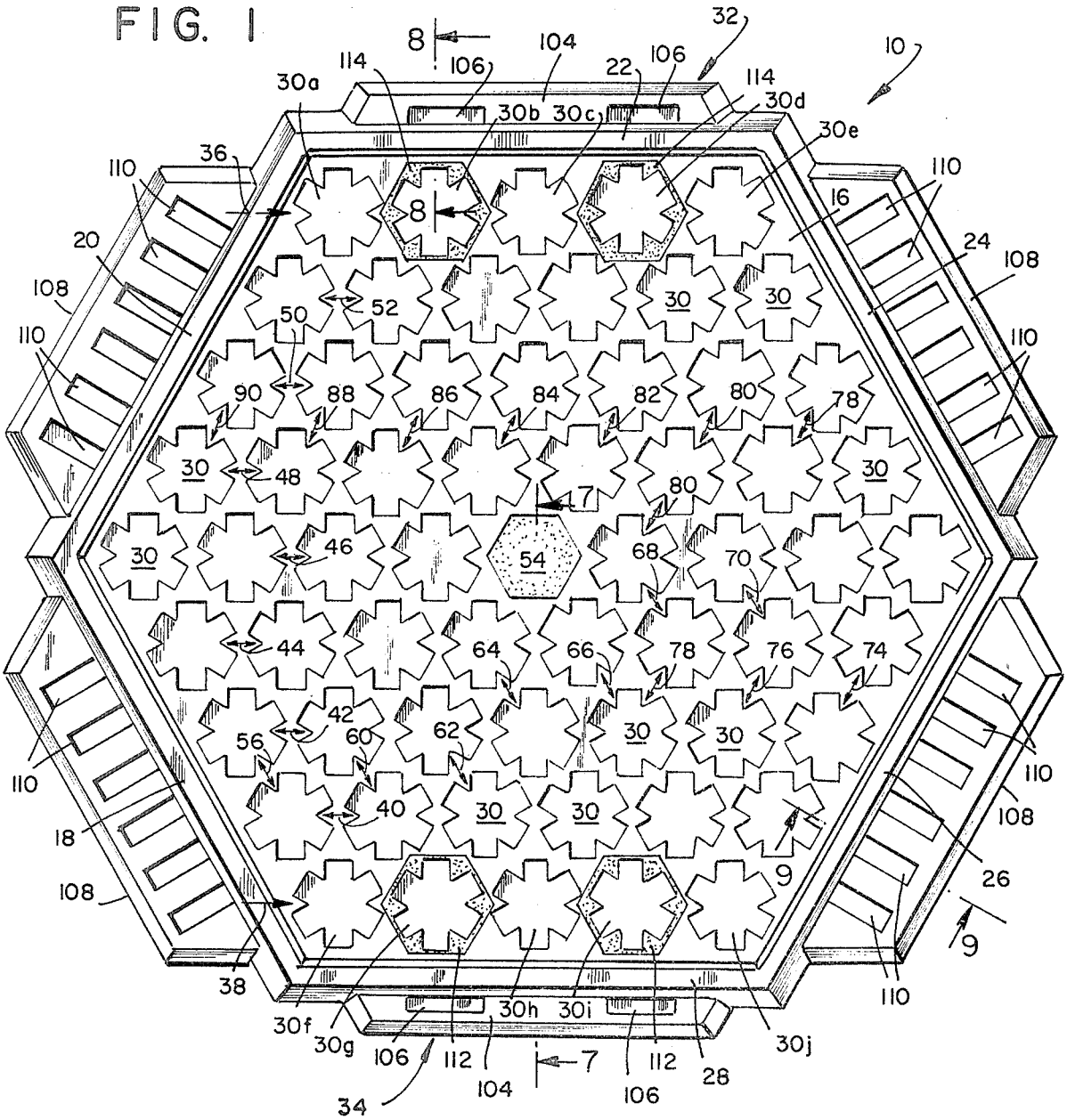
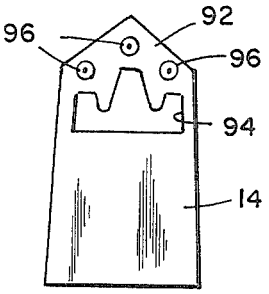
FIG. 2
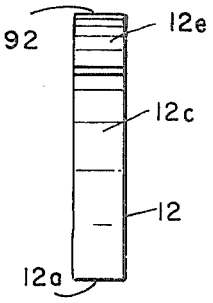
FIG. 3
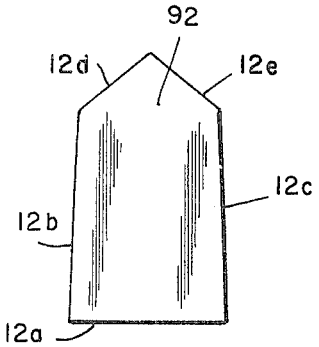
FIG. 4

FIG. 5
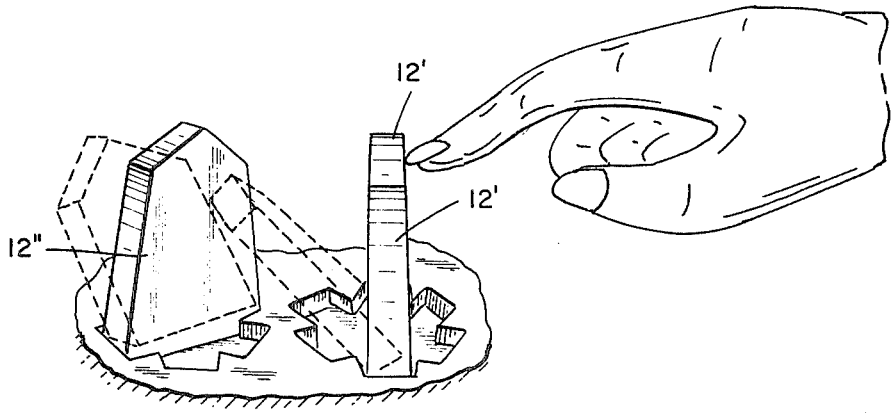
FIG. 7
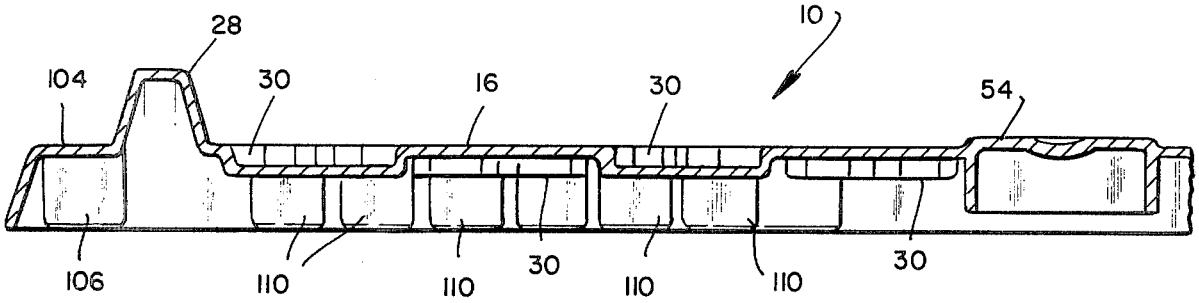
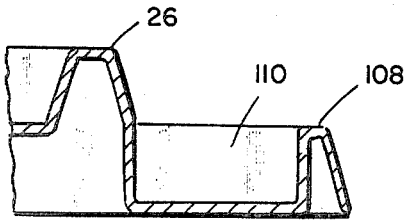
FIG. 9
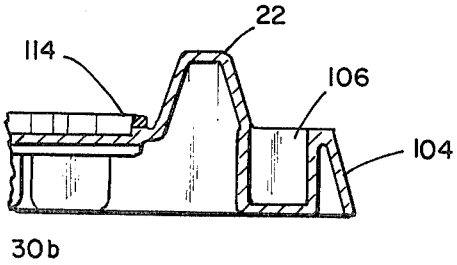
FIG. 8

FIG. 6a
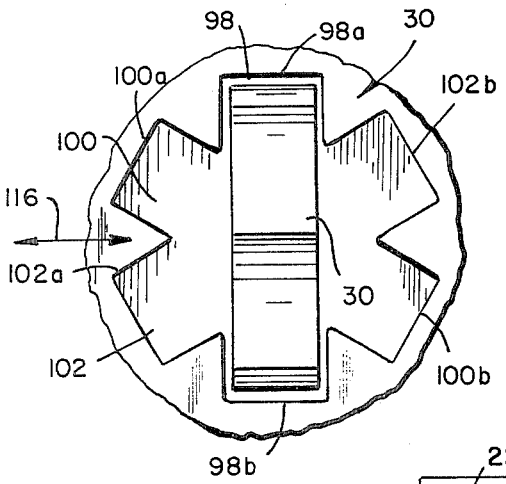
FIG. 6b
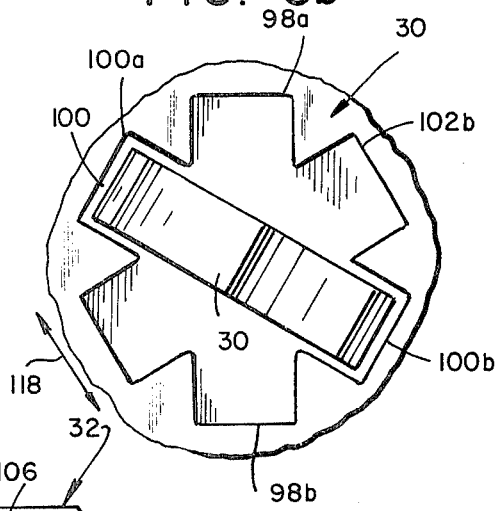
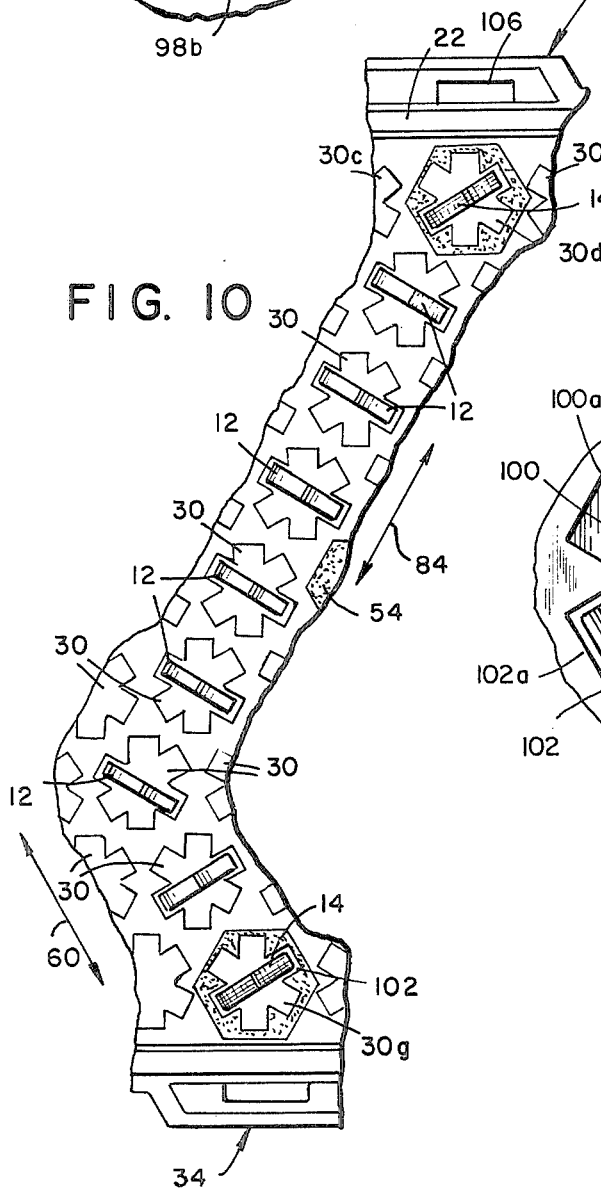
FIG. 10
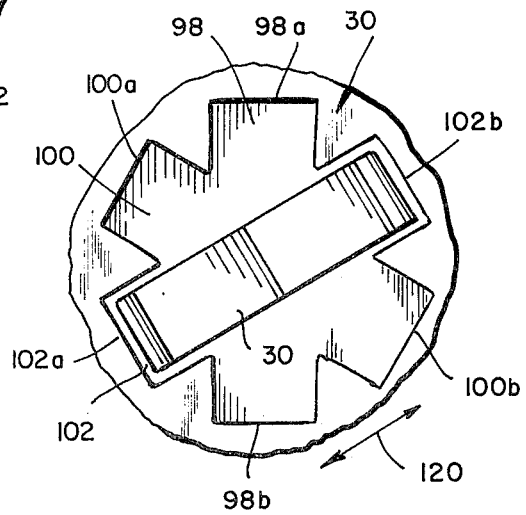
FIG. 6c

CHAIN REACTION FALLING PLAYING PIECES BOARD GAME

The present invention relates to improvements in table games and in particular to an action game in which tile-like playing pieces are arranged in upstanding condition in a row and the row is then caused to collapse by pushing over the first playing piece in the row.

The game utilizes a well-known phenomenon known as the "domino effect" in which a series of closely spaced dominos or rectangular tiles are set in a straight or curved row with their flat faces confronting each other, and one domino at the end of the row is pushed over, striking the next domino which falls to strike the next domino, etc. A chain reaction is thus effected, with each domino falling successively until the entire line of dominos has toppled.

In conventional table games, such as checkers, chess and the like, it is common for each player to be provided with one or more primary playing pieces, sometimes designated as "kings" and a number of secondary playing pieces, designated as "pawns" with the object of the game being to move the pawns about the playing board in such a manner as to "capture" the opponent's kings. These conventional games usually require a considerable amount of strategy in play, but the action is limited to the sliding of the playing pieces from one square or playing area to another.

The board game of the present invention has for its object the capturing of king playing pieces of an opponent, but the play of the game involves the placement of pawn playing pieces in upstanding position upon a playing board and thereafter changing the orientation of selected playing pieces in such a manner as to form a continuous and unbroken line of upstanding playing pieces between one player's king playing piece and his opponent's king playing piece. When such a line is formed, the first player pushes over his king, and a chain reaction of falling playing pieces is effected, with the aforementioned domino effect, causing the opponent's king to topple over, thereby constituting a capture of the opponent's king.

It is the principal object of the present invention to provide an action table game utilizing the aforementioned domino effect, thereby creating considerable interest, unusual playing action, and requiring a marked degree of skill in properly placing and orienting the playing pieces.

Another object of the invention is to provide a game of the character described in which the playing board is provided with cells for insertion of the playing pieces therein selectively-oriented in upstanding positions, the cells being staggered and arranged in a pattern of rows so as to permit the formation of no straight-line row of playing pieces from one king to another. This forces the players to form tortuous lines of playing pieces, thereby increasing the difficulty of play and the play value of the game.

A further object of the invention is the provision of a game of the character described in which the playing pieces have pointed top ends formed with angular upper surfaces which permit a playing piece, when falling, to strike the face of an adjacent playing piece facing in another direction, and to knock over the adjacent playing piece. This permits the chain reaction of falling pieces to continue around angular bends in the line of playing pieces, an effect which could not be achieved by straight-sided rectangular dominos.

In accordance with the invention there is provided a game assembly comprising a playing board having a marginal playing station for each of a plurality of players, at least one king playing piece for each player and a plurality of additional playing pieces for each player. Each of the playing pieces comprises a flat elongated block having a flat bottom surface and adapted to be placed in upstanding position on said playing board. The playing board is formed with a pattern of indented cells adapted to receive the playing pieces therein in upstanding position, the cells being spaced from each other and arranged in diagonal and transverse rows. Each cell is formed of a plurality of intersecting rectangular slots each sized to receive a playing piece and position the latter in one of a plurality of selected oriented positions. At each playing station at least one cell is adapted to receive a king playing piece in upstanding position. The cells are so arranged as to permit only a non-linear row of playing pieces to be formed between a king at one playing station and a king at another playing station, with at least one bend in the row. The formation of a proper continuous and unbroken row of playing pieces from a first king to a second king provides a chain reaction of falling playing pieces in said row when the first king is pushed over, thereby toppling the second king at the end of the row. The playing pieces are formed with pointed upper ends having angular upper surfaces which enable the chain reaction to continue around the bends in said row.

Additional objects and advantages of the invention will become apparent in the course of the following specification when taken in connection with the accompanying drawings, in which:

FIG. 1 is a plan view of the game playing board made in accordance with the present invention;

FIG. 2 is a front elevational view of one of the king playing pieces of the game assembly;

FIG. 3 is a front elevational view of one of the pawn playing pieces of the game assembly;

FIG. 4 is a side elevational view of the playing piece shown in FIG. 3;

FIG. 5 is a fragmentary perspective view of a portion of the playing board showing a pair of playing pieces mounted in different positions in the cells thereof, and illustrating the movement of the playing pieces during the toppling action thereof;

FIGS. 6*a*, 6*b* and 6*c* are plan views of one cell of the playing board, showing the three alternate positions in which the playing pieces may be mounted in the cell;

FIG. 7 is a section taken along line 7—7 of FIG. 1;

FIG. 8 is a section taken along line 8—8 of FIG. 1;

FIG. 9 is a section taken along line 9—9 of FIG. 1; and

FIG. 10 is a fragmentary plan view of the playing board of FIG. 1, showing the manner in which the playing pieces are arranged to form a line from one king playing piece to another.

Referring in detail to the drawings, the table game of the present invention includes a playing board 10, shown in FIG. 1, upon which a plurality of playing pieces 12, 14, shown in FIG. 4, are placed during the playing of the game, in a manner to be presently described.

The playing board 10 is preferably molded of plastic material with a hexegonal configuration, as shown in FIG. 1, and has a flat upper surface 16 bordered at its six straight sides by upstanding marginal flanges 18, 20, 22, 24, 26 and 28. The upper surface 16 is recessed at spaced intervals over its entire extent to form an array of indented playing cells 30 into which the playing pieces 12, 14 are inserted during play of the game. The playing cells 30 are equally spaced from each other and are arranged uniformly in rows which follow the hexegonal configuration of the playing board 10.

The opposite sides of the hexagonal playing board 10 defined by the upstanding flanges 22 and 28 constitute respective playing stations 32 and 34 at which two players are positioned opposite to each other. Along the side constituting the playing station 32, there is arranged a straight row of five playing cells 30*a*, 30*b*, 30*c*, 30*d* and 30*e*, the row extending parallel to the upstanding flange 22, and being identified by the reference numeral 36. Similarly, along the side constituting the playing station 34 is arranged a straight row 38 of five playing cells 30*f*, 30*g*, 30*h*, 30*i* and 30*j*, this row extending parallel to the upstanding flange 28. Between these two rows 36 and 38 are seven intermediate rows of cells 30, these intermediate rows being identified by the arrows 40, 42, 44, 46,48, 50 and 52 in FIG. 1. The cells 30 in each transverse row 36–52 are staggered with relation to the cells in the adjacent rows in the manner illustrated, for example, the cells 30 in the row 40 are centered between the cells of the adjacent rows 38 and 42. Because of the hexagonal shape of the game board 10, the number of cells 30 in each transverse row vary from row to row. In the preferred embodiment shown in FIG. 1, there are five cells in row 38, six cells in the next row 40, seven cells in the next row 42, eight cells in the next row 44, and nine cell spaces in row 46 which extends across the center of the game board. At the other half of the board, the row 36 is formed of five cells, the row 52 of six cells, the row 50 of seven cells, and the row 48 of eight cells.

As previously described, the central transverse row 46 is of such a length that it would include nine playing cells 30. However, the space which would be occupied by the central playing cell is filled in with a cover 54 so that a playing piece cannot be inserted therein. This covered space 54 is located at the exact center of the playing board 10, and its presence prevents any of the rows of cells from forming a direct communication between the two stations 32 and 34, as will be presently described.

The staggered arrangement of the playing cells 30 forms angular rows of cells, designated by the arrows 56 and 58 in FIG. 1, extending along the opposite sides 18 and 24 of board 10. Each row 56 and 58 is formed of five cells 30. Evenly-spaced between these end rows 56 and 58 and parallel thereto, are seven intermediate rows 60, 62, 64, 66, 68, 70 and 72, these rows extending at an angle of 330° to the transverse rows 36–52. The cells 30 in each angular row 56–72 are staggered with relation to those in the adjacent rows and follows the identical arrangement of the transverse rows previously described.

It will also be seen that the cells 30 define nine spaced angular rows 74, 76, 78, 80, 82, 84, 86, 88 and 90 which extend between and parallel to the opposed sides 20 and 26 of game board 10, and are arranged at an angle of 30° to the transverse rows 36–52. The game board illustrated in FIG. 1 is formed with sixty recessed playing cells 30 with a covered cell space 54 at its center. The number of cells are illustrated by way of preferred example only, it being understood that there can be a greater of lesser amount of cells provided, depending upon the size of the playing board 10.

The playing pieces 12 are formed of plastic in the form of a flat elongated block having a flat bottom wall 12*a* and side walls 12*b* and 12*c* which taper inward slightly. Each playing piece has a pointed top end 92 formed by upper wall surfaces 12*d* and 12*e* which are inclined at angles of approximately 45° to the longitudinal axis of the playing piece. The playing pieces 14 are identical in size and shape to the playing pieces 12, except that the playing pieces 14 are formed with cutout portions 94 and 96 configured to represent a crown, thereby indicating that the playing pieces 14 are "kings". On the other hand, the playing pieces 12 have unbroken front and rear surfaces, and represent "pawns".

In the preferred embodiment of the game illustrated in the drawings, each of the two players is provided with two "king" playing pieces 14 and twelve "pawn" playing pieces 12. The playing pieces of one player are distinguished from the playing pieces of the other player by color; for example, the playing pieces 12, 14 of one player may be colored red, while the playing pieces of the other player may be colored blue.

Each of the indented playing cells 30 is shaped in the general form of a truncated star, as shown in FIGS. 1 and 6, to provide three slots into which a playing piece can be selectively inserted. As shown best in FIGS. 5 and 6, the each cell 30 is formed of three intersecting rectangular slots 98, 100 and 102 having respective end portions 98*a*, 98*b*, 100*a*, 100*b*, and 102*a*, 102*b*. As shown in FIG. 1, each of the playing cells 30 is oriented with its rectangular slot 98 extending perpendicularly to the axes of the transverse rows 36–52, the slot 100 extending perpendicularly to the axes of the diagonal rows 74–90, and the slot 102 extending perpendicularly to the axes of the diagonal rows 56–72.

The playing board 10 is provided with two integral storage extensions 104 which extend respectively along each of the playing stations 32 and 34 and project outwardly of the marginal flanges 22 and 28. Each of the storage extensions is formed with a pair of vertical rectangular cavities 106 sized to receive the king playing pieces 14 belonging to the player at that station, and to store these playing pieces 14 in upright condition for easy access. Along each of the side flanges 18, 20, 24 and 26, the playing board is provided with respective storage extensions 108, each formed with six vertical rectangular cavities 110 sized to receive the pawn playing pieces 12 of the two players, and to store these playing pieces 12 in upright condition.

In the transverse row 38 of cells along the playing station 34, two of the cells 30*g* and 30*i* are designated as cells for receiving the king playing pieces 14 belonging to the player at that station. To identify these cells 30*g* and 30*i*, they are bordered with an area 112 of a bright color, for example gold, as shown in FIG. 1. Similarly at the other side of the playing board, at the playing station 32, the cells 30*b* and 30*d* in the transverse row 36 are bordered with a colored area 114 to indicate that these are the cells in which are placed the king playing pieces 14 belonging to the player at that playing station.

As shown in FIGS. 5 and 6, a playing piece 12 or 14 may be inserted in one of the cells 30 in any one of three selected positions. If the playing piece is placed in the rectangular slot 98, as shown in FIG. 6*a*, it will face transversely of the playing board 10 as viewed in FIG. 1, that is, it will face in the direction of the arrow 116 in FIG. 6*a*, which corresponds to the direction of the transverse rows 36–52. If the playing piece is placed in the rectangular slot 100, as shown in FIG. 6*b*, it will face in a diagonal direction indicated by the arrow 118, which direction corresponds to the direction of the diagonal rows 56–72. If the playing piece is placed in the rectangular slot 102, as shown in FIG. 6*c*, it will face in the opposite diagonal direction indicated by the arrow 120, which direction corresponds to the direction of the diagonal rows 74–90.

In playing the game, each player inserts his two king playing pieces 14 into the color-bordered cells 30*g*, 30*i* and 30*b*, 30*d* adjacent his respective playing station 32 or 34. The king playing pieces 14 may be inserted in these cells in any of the three directions, facing transversely or diagonally. The players now take turns in placing the pawn playing pieces 12 alternately in cells 30 of their selection. The object of the game is to form an unbroken line of playing pieces 12 in a path between a king playing piece 14 of one player and a king playing piece of the other player. If this unbroken line of playing pieces is properly formed, and if its path is properly selected, the player completing the path can push over his king playing piece 14, causing all of the intermediate pawn playing pieces 12 in the path to fall over successively in a chain reaction and finally causing the king playing piece of the opponent, at the end of the path, to topple over. This constitutes a "capture" of the opponent's king playing piece.

The action of the playing pieces in toppling successively within their formed line is generally in accordance with the well-known domino effect in which a series of dominos are arranged in upright position on a surface in a row with their faces substantially parallel to each other, in such a manner that when the first domino is pushed over, it strikes the face of the next domino which falls and strikes the face of the next domino, etc. The dominos in the row thus fall successively in a cascading action until the entire row has been knocked over.

Referring to FIG. 1, it will be seen that the staggered rows of cells 30 are so arranged that there is no unbroken straight line of cells which extend from one king cell 30*g*, 30*i* to an opposite king cell 30*b*, 30*d*. Further, there are only two diagonal rows which extend in a straight line from one playing station 32 to the opposite playing station 34, these being the diagonal row 82 which extends between cells 30*e* and 3*f*, and the diagonal row 66 which extends between cells 30*a* and 30*j*. Both of these rows 66 and 82 are interrupted at their centers by the covered-over cell space 54. Thus it is not possible to erect a straight line of playing pieces 12 extending from one king playing piece 14 to an opposite king playing piece. A line of playing pieces, extending from one king playing piece to an opposite king playing piece, must follow a devious path with at least one bend therein, and this requirement calls for a degree of skill in the play of the game and augments its play value.

Since the pawn playing pieces must be arranged in a nonlinear row with one or more diagonal bends therein, in order to extend between two king playing pieces, it is necessary for the array of playing pieces to be capable of turning corners in their cascading action of toppling successive pieces. For this purpose, all of the playing pieces 12 and 14 are formed with the pointed top ends 92 shown in FIGS. 2 and 3. The angular side surfaces 12*d* and 12*e* perform a camming action upon a succeeding playing piece arranged in an angular direction, thereby knocking over the succeeding playing piece. This camming action is shown in FIG. 5 in which a first playing piece 12', arranged in its cell facing transversely, is caused to topple over in a transverse direction, as shown in broken line, thereby striking the succeeding playing piece 12'' which is arranged in a diagonal direction. The face of the succeeding playing piece 12'' is struck by the angular upper side surface of the pointed top end 92 of the first playing piece 12', and a camming force is applied thereto, causing the succeeding playing piece 12'' to topple over but in a direction angular to the transverse direction in which the first playing piece 12' has fallen. This camming action could not be achieved if the playing pieces were made entirely rectangular in the manner of dominos.

FIG. 10 shows, by way of example, a properly aligned row of pawn playing pieces 12 extending between two king playing pieces 14. It will be observed that the king playing piece 14 in the cell 30*g* at playing station 34 is parallel to the next pawn playing piece 12 in the adjacent cell 30 in diagonal row 60. The next playing piece 12 is set diagonally in the opposite direction in row 60, and is parallel to five succeeding playing pieces in row 84, the last of which faces the king playing piece 14 in the cell 30*d* at the opposite playing station 32, the latter king playing piece being set in a diagonal position opposite to the diagonal position of the preceding playing piece.

If the player at playing station 34 pushes over his king playing piece 14 in cell 30*g*, it will fall in the diagonal direction determined by the slot 102 of cell 30*g*, striking the next playing piece 12 and causing the latter to fall in the same direction. As this playing piece falls its pointed top end engages and cams the adjacent face of the next playing piece, causing the latter to topple, but in the opposite diagonal direction, and causing a chain reaction of falling playing pieces in the same direction through the next five playing pieces, the last of which strikes the opponent's piece 14 in cell 30*d* with a camming action, thereby causing the king piece to fall in the opposite diagonal direction. Since the falling action of the first player's king piece at station 34 results in toppling of the second player's king piece at station 32, the first player has succeeded in capturing a king of his opponent.

It will be seen that with the playing pieces arranged in the line shown in FIG. 10, the player at station 32 cannot capture his opponent's king by toppling his own king playing piece in cell 30*d*. If this king playing piece is pushed over, it will fall without engaging the adjacent pawn playing piece. In addition, if the playing pieces were to fall in a direction from playing station 32 toward playing station 34, there would also be a break in the chain of toppling playing pieces at the bend where row 82 joins row 60. The last playing piece in the row 82 would fall without striking the next playing piece in row 60.

In accordance with the rules of the game, each player sets his two king playing pieces 14 in the king cells 30*g*, 30*i* or 30*b*, 30*d* at his playing station in any of the three designated positions. The players then alternate in setting their pawn playing pieces in cells of their selection, or in changing the position of one or more playing pieces until one player feels that he has established a line between one of his king playing pieces and a king playing piece of his opponent, whereupon, he initiates a chain reaction by pushing over his king.

In each player's turn, he is allowed two of three possible moves. One move constitutes placing one of the player's pawn pieces in a cell in any selected position. Another move is changing the position of his pawn piece or his king piece within its cell. The third possible move is pushing over his king piece to cause a chain reaction of falling playing pieces to topple his opponent's king piece. In the player's turn, he may make two identical moves, or may make two of the possible three moves in any combination.

When a player attempts to capture his opponent's king by pushing over his king piece, if the chain reaction of cascading pieces is successful in toppling over the opponent's king piece, the opponent's king piece is considered captured and removed from the playing board, together with all of the pawn pieces in the chain which have fallen over. The player's own king piece is replaced in its designated cell, and play continues. If a player attempts to capture his opponent's king piece, but the attempt is unsuccessful by reason of a break in the chain which results in the opponent's king piece remaining upright, the unsuccessful player's king is lost and is removed from the board together with all of the pawn pieces which have fallen. The game ends when one player has lost both his king pieces, the opponent being declared the winner.

While a preferred embodiment of the invention has been shown and described herein, it is obvious that numerous omissions, changes and additions may be made in such embodiment without departing from the spirit and scope of the invention.

What is claimed is:

1. A table game assembly comprising a game board having a plurality of marginal playing stations at different sides of the board for a plurality of players, at least one primary playing piece for each of said players, and a plurality of secondary playing pieces for each of said players, each of said playing pieces comprising a flat elongated block having a flat bottom surface and adapted to be placed in upstanding position on said playing board, said playing board being formed with a plurality of indented cells arranged in a pattern over the surface thereof and each sized to receive a playing piece therein in upstanding position, said cells being arranged in said pattern to permit a continuous and unbroken row of secondary playing pieces to be set in upright position between a first primary playing piece adjacent one playing station and a second primary playing piece adjacent another playing station, each of said cells being formed of a plurality of intersecting rectangular slots, each sized to receive therein a playing piece and arranged to position the latter in a selected oriented position, said playing board having two playing stations located along opposite side edges of said playing board, and said indented cells being arranged in transverse rows extending parallel to said opposite side edges, with the cells in each of said transverse rows being evenly spaced from each other and located midway between the cells of the adjacent rows, whereby to form rows of cells extending in opposite directions diagonally to said transverse rows, at least one cell in each transverse row adjacent each playing station being marked for identification to receive a primary playing piece of the player at that playing station, said pattern of cells being so arranged that a continuous and unbroken row of secondary playing pieces between a first primary playing piece at one playing station and a second primary playing piece at the opposite playing station can only be formed in an irregular line having a portion extending along at least one diagonal row of cells of one direction and a portion extending along at least one diagonal row of cells of the opposite direction: said irregular line having at least one bend therein, whereby a chain reaction of falling secondary playing pieces in said row is caused by manually pushing over said first primary playing piece, thereby toppling over said second primary playing piece at the end of said row.

2. A table game according to claim 1 in which each of said playing pieces has a pointed top end defined by angular upper side surfaces, the angular upper side surfaces of each playing piece being positioned to engage the flat face of a playing piece arranged in a different angular direction when the first playing piece is caused to fall.

3. A table game according to claim 2 in which each cell is formed of three intersecting rectangular slots, with a first of said slots extending perpendicularly to the transverse rows of cells, a second slot extending parallel to one of said diagonal rows of cells, and a third slot extending parallel to the other of said diagonal rows of slots.

4. A table game according to claim 1 in which said playing board is hexagonal in shape having six flat sides bordered by an upstanding marginal flange.

5. A table game according to claim 4 in which said board is formed with integral extension portions projecting from the sides thereof, each of said extension portions having a plurality of recesses therein for removably receiving playing pieces and holding the latter in stored condition.

* * * * *